US005531640A

United States Patent [19]

Inoue

[11] Patent Number: 5,531,640

[45] Date of Patent: Jul. 2, 1996

[54] COIN DISPENSER

[75] Inventor: Haruo Inoue, Tokyo, Japan

[73] Assignee: Eagle Co., Ltd., Tokyo, Japan

[21] Appl. No.: 337,525

[22] Filed: Nov. 8, 1994

[30] Foreign Application Priority Data

Nov. 8, 1993 [JP] Japan ..... 5-278193

[51] Int. Cl.[6] ..... G07D 1/00

[52] U.S. Cl. ..... 453/17; 453/56

[58] Field of Search ..... 453/17, 20, 32, 453/33, 34, 35, 56

[56] References Cited

U.S. PATENT DOCUMENTS

| | | | |
|---|---|---|---|
| 3,401,704 | 9/1968 | Jullien-Davin | 453/17 |
| 3,998,237 | 12/1976 | Kressin et al. | 453/32 X |
| 4,342,384 | 8/1982 | Fukase et al. | 453/56 X |
| 4,383,540 | 5/1983 | DeMeyer et al. | 453/32 X |
| 5,366,110 | 11/1994 | Takemoto et al. | 453/17 X |

*Primary Examiner*—F. J. Bartuska
*Attorney, Agent, or Firm*—Young & Thompson

[57] ABSTRACT

An endless belt conveyor is disposed between a coin receptacle and a hopper. Coins stored in the coin receptacle fall from an outlet at the lower portion of the coin receptacle and are supported and held on the endless belt. When the endless belt circulates, coins on the endless belt are transported toward the hopper and dropped into the bucket. The bucket is provided therein with a first sensor for detecting a lower limit of the number of coins and a second sensor for detecting an upper limit of the number of coins. In response to a signal from the first sensor, the endless belt circulates, and in response to a signal from the second sensor, the endless belt stops. The coin receptacle has a supply port for replenishment with coins. A protective cover is securely fixed to the supply port, the protective cover having a lattice pitch allowing a coin to pass but preventing a human hand from entering.

14 Claims, 3 Drawing Sheets

COIN DISPENSER

BACKGROUND OF THE INVENTION

1. Field of the Invention

The present invention relates to a coin dispenser to be used for money changers and the like.

2. Description of the Related Art

Note exchangers and coin exchangers are installed in gaming halls, casinos, and the like where various game machines are used. A note exchanger changes notes (bills) to coins, game tokens or medals. A coin exchanger changes coins to game tokens and medals. In this specification, coins, game tokens and medals are collectively called coins for simplicity of description. Such an exchanger has a unit for judging whether inserted money, coins, or the like is forged or not, and a coin dispenser for dispensing coins in the amount of the inserted money if the money is judged to be genuine. The coin dispenser has a coin receptacle and a hopper into which coins are ejected one after another.

The coin receptacle stores a number of coins, and has a coin entry port at its top and a coin outlet port at its bottom. Coins are supplied from the coin outlet port to the hopper, either directly or via a coin chute of tunnel shape.

The hopper has a bucket and a rotary disk mounted in the bottom of the bucket obliquely or horizontally. The bucket stores a suitable number of coins supplied from the hopper. In response to a pay signal, the rotary disk is rotated by a motor. The rotary disk pays out several to ten coins one after another per one rotation. The number depends on the diameter of the disk. A coin sensor is provided at the outlet of the hopper to count the number of coins paid out and to stop the motor when dispensed coins equal the inserted money.

With a conventional coin dispenser, the weight of all coins in the coin receptacle is borne by the rotary disk because the coins are in contact with each other from the outlet port of the coin receptacle to the inside of the bucket. As a result, if the capacity of the coin receptacle is made large in order to reduce the frequency of coin replenishment, an excessive pressure is applied to the rotary disk of the hopper and the rotation speed of the rotary disk is reduced until it is unable to pay out coins at a high speed, or smoothly, because of irregular rotation. Besides, the motor is compelled to rotate under an excessive load, shortening the lifetime thereof or burning it out.

In order to eliminate such troubles, a shutter has been provided between the coin receptacle and the hopper so as not to impose the weight of coins in the coin receptacle on the rotary disk. However, when the shutter is closed, it pushes and thrusts coins aside so that a very large load is applied to the shutter. In addition, a long stroke is required for opening and closing the shutter so that a robust actuator is needed.

With a conventional exchanger, a single hopper is used for paying out coins. In order to pay out coins at a high speed, it is necessary for the hopper to have a high coin pay out speed. There is, however, a limit to the coin pay out speed. Furthermore, when a hopper of a conventional exchanger becomes out of order or the coin passage is clogged by coins, coins cannot be paid out immediately thereafter. In such a case, a user still not provided with all his coins must wait until the exchanger is repaired.

For the inspection and repair of the internal structure of a defective exchanger, the hopper is dismounted. In this case, the dismounting operation becomes very cumbersome or difficult if a large load is being applied to the hopper. The frequency of coin replenishment can be reduced if the capacity of the coin receptacle is increased; however, it is then more likely that coins will be stolen by breaking the coin supply port, because the exchanger will be left untouched by any attendant for a longer period of time.

OBJECTS OF THE INVENTION

It is a principal object of the present invention to provide a coin dispenser capable of eliminating adverse effects upon the hopper even if the capacity of the coin receptacle is large.

It is another object of the present invention to provide a coin dispenser capable of preventing coins in a coin receptacle from being stolen.

SUMMARY OF THE INVENTION

In order to achieve the above and other objects of the invention, coin transporting means is provided between a coin receptacle and a hopper. When this coin transporting means is halted, coins falling from the outlet of the coin receptacle are received and held by the coin transporting means, and during the operation of the coin transporting means, coins are transported toward the bucket and poured into the bucket.

In order to speed up coin payment, a coin receptacle of a large capacity having a plurality of outlets is used. For each outlet, the coin transporting means and a hopper are provided. As the coin transporting means, an endless belt is preferably used. The driving and stopping of the endless belt are effected in accordance with the number of coins stored in the bucket. In order to prevent theft of coins, a protective cover is securely fixed to the bucket at the supply port, the protective cover being formed with a large number of openings or slots which allow coins to pass but prevent a human hand from entering.

Coins supplied from the outlet of the coin tank are temporarily held on the coin transporting means. The coin transporting means provides continuity between the coin receptacle and the bucket and prevents the weight of coins in the coin receptacle from being applied to the hopper. As the hopper pays out coins and the number of coins in the bucket is reduced, the coin transporting means is driven to transport the coins on the transporting means and coins are supplied thereafter from the outlet, toward the bucket.

High speed paying out of coins is achieved by providing a plurality of outlets from the coin receptacle, providing coin transporting means and a hopper for each outlet, and operating the plurality of coin transporting means and hoppers at the same time. Even if one of the plurality of coin transporting means and hoppers becomes out of order, another hopper can be used to continuously pay out coins. It is also advantageous in that coin replenishment can be performed for a single coin receptacle.

Since the coin receptacle is replenished with coins through the protective cover having a lattice pitch preventing a human hand from entering, coins cannot be stolen from outside the dispenser.

According to the invention, since the coin transporting means is provided between the coin receptacle and the hopper, the weight of the number of coins in the coin receptacle is not imposed on the hopper, thereby ensuring smooth coin payment and allowing the hopper to be easily dismounted from the apparatus main body for inspection and maintenance of the apparatus.

BRIEF DESCRIPTION OF THE DRAWINGS

The above and other objects and advantages of the present invention will become apparent from the detailed description of a preferred embodiment when read in conjunction with the accompanying drawings, in which.

DETAILED DESCRIPTION OF THE PREFERRED EMBODIMENT

Figure 1:
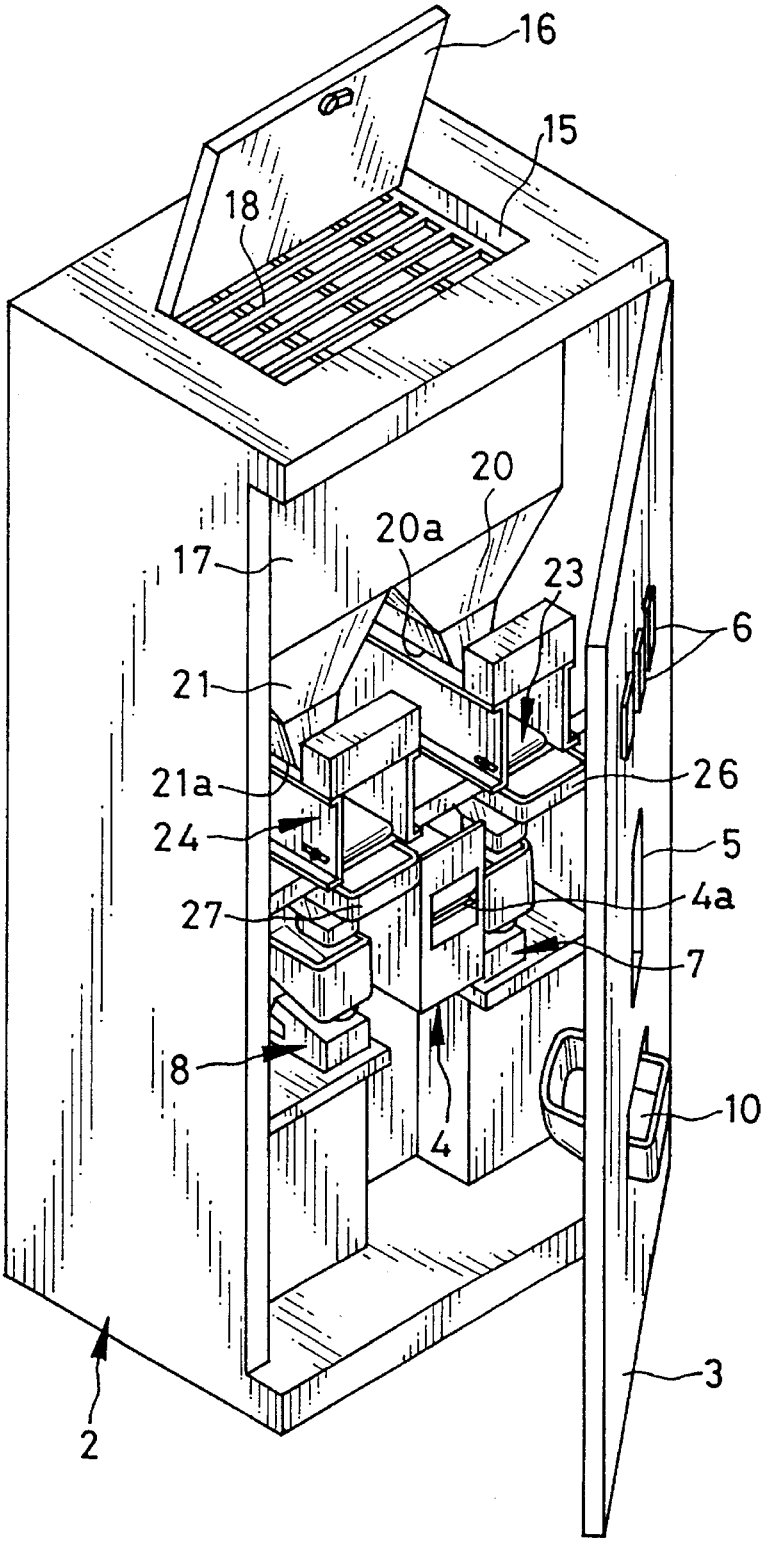
FIG. 1 is a perspective view of an exchanger with a coin dispenser according to an embodiment of the invention.

A coin dispenser of the invention will be described by using a note exchanger by way of example. As shown in FIG. 1, a door 3 is mounted at the front of an exchanger main body 2. The door 3 is opened when the exchanger is inspected or repaired. In the exchanger main body 2, a note discriminator 4 is provided which pulls a note (bill) inserted through an opening 5 of the door 3 into the inside thereof via a slit 4*a*, and measures it by a magnetic or optical sensor to detect the denomination of the note and to discriminate between a forged note and a genuine note. The detected type of the note is displayed by turning on a display lamp 6, and a hopper 7, 8 operates to pay out coins as many as the inserted money amount into a coin saucer 10. A note discriminator having a function of paying back notes of small denominations may be used, with operation switches additionally mounted on the door 3. In this case, if a user inserts a note of a large denomination and operates the operation switches to designate the number of coins, the coins can be paid and proper notes of smaller denominations can be returned for the remainder of the note of large denomination.

A coin supply port 15 is formed in the upper frame of the exchanger main body 2, the coin supply port becoming accessible by opening a door 16. A coin receptacle 17 is installed under the supply port 15 and can store about forty to fifty thousand coins 60 inserted via the supply port 15. A protective cover 18 is securely fixed to the supply port 15. The protective cover 18 is of a lattice structure as shown, the pitch between lattices being set to allow coins to pass but to prevent a human hand from entering. Since the protective cover 18 is securely fixed to the main body 2 by bolts 18*a*, it cannot be dismounted from outside the dispenser.

The bottom of the coin receptacle 17 is formed with two funnel-shaped discharge ports 20 and 21 through which coins drop. The lower ends of the discharge ports 20 and 21 are open, constituting coin outlets 20*a* and 21*a*. Belt conveyors 23 and 24 are mounted below the outlets 20*a* and 21*a*. The belt conveyors 23 and 24 forming coin transporting means circulate their endless belts to transport coins dropped from the outlets 20*a* and 21*a*, to hoppers 7 and 8 via funnel-shaped chutes 26 and 27.

The two hoppers 7 and 8 allow coins to be paid out at a high speed. Paying out coins is performed by the two hoppers 7 and 8 after replenishing the single coin receptacle 17 with coins. If one of the hoppers becomes defective, the other hopper is usable to pay out coins.

Figure 2:
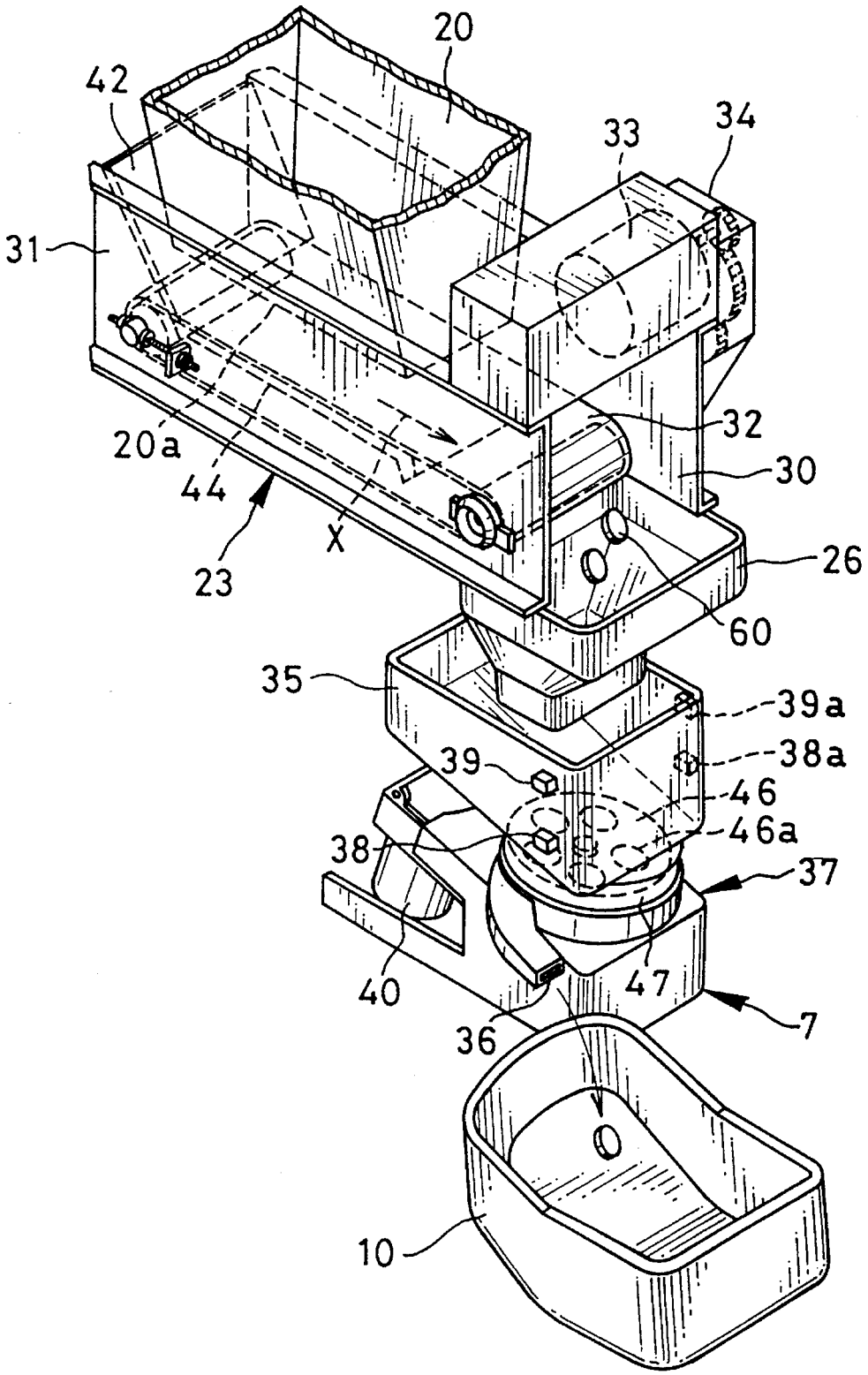
FIG. 2 is a perspective view of the coin dispenser of the embodiment.

Referring to FIG. 2, the belt conveyor 23 has a pair of plates 30 and 31 and an endless belt 32 disposed therebetween. The endless belt 32 is driven by a motor 33 and a speed reduction gear box 34 and moves in the direction of an X arrow shown in FIG. 2. The endless belt 32 is a thick, tough cloth covered with rubber, and supports and holds coins dropped from the outlet 20*a* while the motor 33 is stopped. The chute 26 is positioned at the downstream end of the belt conveyor 23, and transports coins 60 dropped from the endless belt 32 towards the hopper 7.

In order to reliably hold coins in the area generally just under the outlet 20*a*, there are provided a regulating plate 42, a resilient sheet 43, and a support plate 44, respectively between the plates 30 and 31. The regulating plate 42 and resilient sheet 43 are provided so as to hold coins 60 dropped from the outlet 20*a* within a predetermined area on the endless belt 32. The resilient sheet 43 is made of soft and flexible synthetic resin, and when coins 60 are transported by the endless belt 32, it is deflected as shown by a two-dot chain line shown in FIG. 4 to allow coins 60 to pass under it. The support plate 44 supports the underside of the endless belt 32 in the area generally just under the outlet 20*a*, thereby preventing the endless belt 32 from sagging under the weight of the coins.

The hopper 7 has a bucket 35 and a coin ejector 37. The bucket 35 stores coins 60 falling from the chute 26, and the coin ejector 37 ejects coins 60 from the bucket 35 one after another through its outlet 36. Photosensors 38 and 39 are mounted on the bucket 35 at different heights to receive light from corresponding light projectors 38*a* and 39*a*. A processor (monitor circuit) continuously monitors whether the photosensors 38 and 39 are receiving light. If the lower photosensor 38 is receiving light from the projector 38*a*, the number of coins 60 in the bucket 35 is insufficient. In this case, the processor outputs a coin supply signal. If the upper photosensor 39 is not receiving light from the projector 39*a*, a sufficient number of coins are being stored in the bucket 35. In this case, the processor outputs a coin supply stop signal. In place of the photosensors, two switches to be turned on by coins may be mounted on the inner wall of the bucket 35.

The coin ejector 37 is constituted, as is well-known, by a rotary disk 46, a housing 47, and the like. The rotary disk 46 is rotated in one direction by a motor 40. The housing 47 surrounds the rotary disk 46 which has a plurality of, for example, five recesses 46*a* in which coins are accommodated. Five coins one in each recess 46a are ejected from the outlet 36 while the rotary disk 46 rotates once. A coin sensor is mounted along a coin discharge path communicating with the coin outlet 36 to detect each passing coin and to emit a coin detection signal. This detection signal is inputted to a counter to count the number of paid out coins. A coin saucer 10 is provided under the coin outlet 36 to receive coins supplied from the hopper 7 and to allow the user to pick them up from the outside of the door 3.

Figure 3:
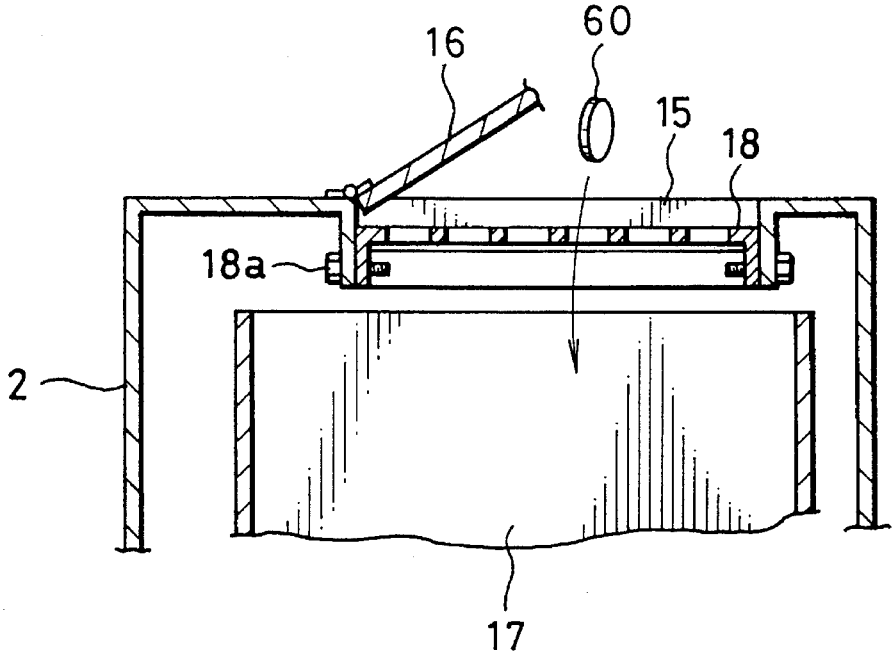
FIG. 3 is a cross-sectional view showing the main part near a supply port.

Next, the operation of the above-described exchanger will be described. Prior to the opening of a gaming hall, the door 16 is opened and tens of thousands of coins are poured onto the protective cover 18 in the supply port 15. Since the lattice pitch of the direction perpendicular to the drawing sheet of FIG. 3 is greater than the outer diameter of coins 60, coins 60 pass between lattices of the protective cover 18 and fall into the coin receptacle 20. Also, since the lattice pitch of the protective cover 18 is smaller than the size of a human hand, coins once stored in the coin receptacle 17 cannot be retrieved by a human hand reaching through the protective cover 18. In addition, since the protective cover 18 is securely fixed at its lower portion to the exchanger main body 2 by bolts as shown in FIG. 3, the protective cover 18 cannot be dismounted easily even if the door 16 is broken during an attempted theft, thereby providing sufficient security. Instead of fixing the protective cover 18 to the main body 2 at the supply port 15, it may be fixed to the coin receptacle 17, covering the upper opening of the coin receptacle 17.

Figure 4:
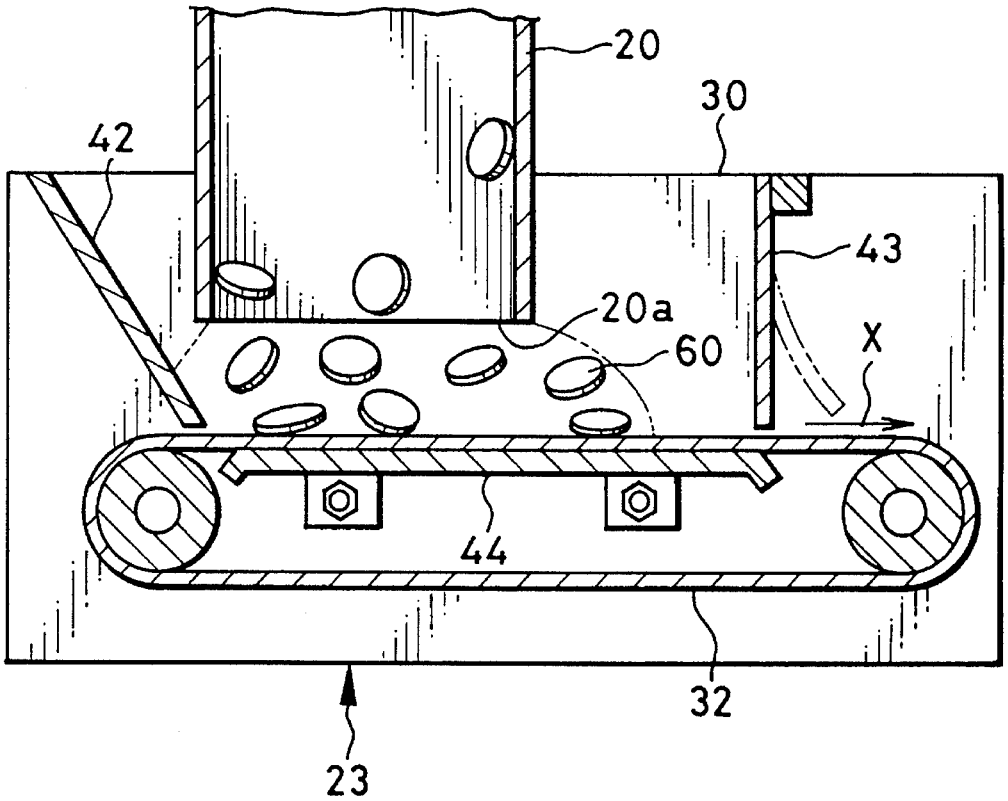
FIG. 4 is a cross-sectional view of a coin transport unit.

The large number of coins fed into the coin receptacle 17 move downward by gravity toward the discharge ports 20 and 21 and fall onto the belt conveyors 23 and 24 via the outlets 20*a* and 21*a*. If the belt conveyors 23 are halted, coins 60 dropping from the outlet 20*a* are held on the top surface of the endless belt 32 and pile up on each other as shown in FIG. 4, within the space defined by the plates 30 and 31, regulating plate 42, and resilient sheet 43. Since the surface of the endless belt 32 is coated with rubber to increase friction, coins will not slide on the surface of the endless belt 32 or move in the downstream direction. Also, since the underside of the endless belt 32 is supported by the support plate 44, the endless belt 32 is prevented from sagging under the weight of the coins. Instead of the support plate 44, a plurality of rollers may be juxtaposed to obtain similar effects.

After a note is inserted into the exchanger, the hopper 7 operates to pay out coins. During this coin payment, each coin is detected and counted by the counter. When the count value reaches a value corresponding to the money amount, the operation of the hopper 7 is stopped.

As the number of coins 60 in the bucket 35 gradually reduces by coin payment and the surface level of coins 60 becomes lower than the line interconnecting the light projector 38*a* and photosensor 38, the latter 38 receives light from the light projector 38*a*. The processor then outputs the coin supply signal. In response to this signal, the motor 33 of the belt transport unit 23 is driven. The endless belt 32 therefore circulates in the direction of the arrow X. As a result, the coins 60 on the upper surface of the endless belt 32 and coins 60 falling from the outlet 20*a* thereafter are transported and dropped downward into the chute 26.

Coins 60 dropped into the chute 26 are fed to the inside of the bucket 35 of the hopper 7. As the number of coins housed within the bucket 35 increases and light emitted from the light projector 39*a* is intercepted by coins 60 in the bucket 35, the photosensor 39 becomes unable to receive light and the processor outputs the coin supply stop signal. In response to this signal, the motor 33 of the belt conveyor 23 is stopped and coins from the outlet 20*a* are prevented from being dropped away from the belt conveyor 23 as shown in FIG. 4.

In the subsequent operation, the light reception states of the photosensors 38 and 39 are monitored by the processor. When the processor outputs the coin supply signal, the belt transport unit 23 is driven, and when the processor outputs the coin supply stop signal, the belt transport unit 23 is stopped. As described above, the provision of the belt transport unit 23 between the coin tank 17 and hopper 7 prevents the weight of the coins in the coin receptacle 17 from being applied to the hopper 7, thereby relieving an excessive load on the hopper 7. Accordingly, not only can the operation of the hopper 7 always be stable, but, also, the hopper 7 can be dismounted from the exchanger main body 2 for the inspection and maintenance thereof, without specific additional work.

The operation along the path from the outlet 21*a* to the hopper 8 is similar to that along the path from the outlet 20*a* to the hopper 7. The two hoppers 7 and 8 run cooperatively to pay out a predetermined number of coins. The invention is obviously applicable to the exchanger having only one payment path from the outlet to the hopper.

As the coin transporting means, a rotary plate or the like may be used in place of the endless belt. Three or more paths from the outlets to the hoppers may be used. The control over the coin conveyor is not limited to signals from the sensors mounted on the bucket 35. For example, the coin conveyor can be driven for a predetermined time period when the counted value of the coins ejected from the hopper 7 reaches a preset value.

Although the invention has been described using an exchanger by way of example, it may be applied to a pay-out unit assembled with a slot machine for paying out a predetermined number of coins when a win has occurred.

Various modifications, changes, combinations and the like of the present invention can be effected without departing from the spirit and scope of the appended claims.

I claim:

1. A coin dispenser having a coin receptacle adapted to store a number of coins, and provided with a coin outlet formed at the bottom of the receptacle, and a hopper for paying out coins from a bucket coin by coin, the coins in the coin receptacle being supplied to the bucket through the outlet, said coin dispenser comprising:

a coin conveyor disposed under said outlet, said coin conveyor transporting coins supplied from said outlet to said bucket during operation of said coin conveyor but retaining coins supplied from said outlet when said coin conveyor is stopped; and a plurality of upright walls surrounding and spaced outwardly from said outlet, said walls defining a space closed downwardly by said conveyor and limiting the number of coins that can emerge from said outlet and rest on said conveyor when said conveyor is stopped.

2. A coin dispenser according to claim 1, wherein said coin dispenser is built in an exchanger for changing notes to coins.

3. A coin dispenser according to claim 1, wherein said coin receptacle has a supply port through which said coin receptacle is replenished with coins, said supply port being covered with a protective cover having a lattice pitch allowing said coins to pass but preventing a human hand from entering.

4. A coin dispenser according to claim 1, wherein said coin conveyor comprises an endless belt disposed under said outlet and circulating when operated, one end of said endless belt being positioned above said bucket.

5. A coin dispenser according to claim 4, wherein said endless belt is disposed horizontally and is vertically spaced from said outlet a distance that regulates the height of a plurality of coins on said endless belt.

6. A coin dispenser according to claim 4, further comprising means to drive said endless belt in accordance with the number of coins stored in said bucket.

7. A coin dispenser according to claim 6, wherein said bucket is provided therein with a first sensor for detecting a lower limit of said number of coins and a second sensor for detecting an upper limit of said number of coins, said endless belt operating in response to a signal from said first sensor stopping, in response to a signal from said second sensor.

8. A coin dispenser according to claim 7, wherein said first and second sensors are photosensors, in each of which a light projector and a light receptor are disposed traversing said bucket.

9. A coin dispenser according to claim 1, wherein one of said upright walls is located nearest to said bucket among said upright walls, is resilient, and is deflected by coins during said operation of said coin conveyor, to allow moving coins out of said space.

10. A coin dispenser having a hopper, the hopper having a rotary disk that rotates under a number of coins housed in a bucket to sequentially pay out coins one by one, comprising:

a coin receptacle for storing a number of said coins;

a plurality of outlets formed in a lower portion of said coin receptacle;

a plurality of endless belts provided one for each outlet, for transporting said coins supplied from said outlet to said bucket during operation of each said endless belt, and for allowing said coins supplied from said outlet to remain on the belt during the stopped state of each said endless belt; and a plurality of upright walls surrounding and spaced outwardly from each said outlet, said walls defining spaces closed downwardly by said conveyors and limiting the number of coins that can emerge from each said outlet and rest on the associated said conveyor when said associated conveyor is stopped.

11. A coin dispenser according to claim 10, wherein said coin receptacle has a supply port from which said coin receptacle is replenished with coins, said supply port being covered with a protective cover having a lattice pitch allowing coins to pass but preventing a human hand from entering.

12. A coin dispenser according to claim 11, wherein said endless belts are substantially horizontal.

13. A coin dispenser according to claim 12, wherein said bucket is provided therein with a first sensor for detecting a lower limit of said number of coins and a second sensor for detecting an upper limit of said number of coins, said endless belt operating in response to a signal from said first sensor, and said endless belt stopping in response to a signal from said second sensor.

14. A coin dispenser according to claim 10, wherein one of said upright walls is located nearest to said bucket among said upright walls, is resilient, and is deflected by coins during said operation of said coin conveyor, to allow moving coins out of said space.

* * * * *